United States Patent [19]

Mausner et al.

[11] 4,335,694

[45] Jun. 22, 1982

[54] FUEL SUPPLY SYSTEM FOR INTERNAL COMBUSTION ENGINES

[75] Inventors: Eberhard Mausner; Johannes Brettschneider, both of Ludwigsburg, Fed. Rep. of Germany

[73] Assignee: Robert Bosch GmbH, Stuttgart, Fed. Rep. of Germany

[21] Appl. No.: 219,274

[22] Filed: Dec. 22, 1980

Related U.S. Application Data

[63] Continuation of Ser. No. 46,286, Jun. 7, 1979, abandoned.

[30] Foreign Application Priority Data

Aug. 30, 1978 [DE] Fed. Rep. of Germany ..... 2837820

[51] Int. Cl.[3] ..... F02D 35/00

[52] U.S. Cl. ..... 123/478; 123/480

[58] Field of Search ..... 123/478, 480

[56] References Cited

U.S. PATENT DOCUMENTS

| | | | |
|---|---|---|---|
| 3,688,750 | 9/1972 | O'Neill | 123/478 |
| 3,750,632 | 8/1973 | Zechnall | 123/478 |
| 4,050,878 | 9/1977 | Priegel | 123/478 |
| 4,051,816 | 10/1977 | Masaki | 123/478 |
| 4,105,000 | 8/1978 | Wessel et al. | 123/478 |
| 4,121,545 | 10/1978 | Mizote | 123/478 |
| 4,131,087 | 12/1978 | Williams | 123/478 |
| 4,134,379 | 1/1979 | Stumpp | 123/478 |
| 4,138,979 | 2/1979 | Taplin | 123/478 |
| 4,173,957 | 11/1979 | Hattori et al. . | |
| 4,174,694 | 11/1979 | Wessel et al. | 123/478 |
| 4,181,944 | 1/1980 | Yamauchi et al. . | |
| 4,184,466 | 1/1980 | Nagele | 123/478 |
| 4,188,922 | 2/1980 | Aoki | 123/478 |

*Primary Examiner*—R. A. Nelli

*Attorney, Agent, or Firm*—Edwin E. Greigg

[57] ABSTRACT

A fuel control system for an internal combustion engine in which the accelerator pedal is set by the operator and defines an air flow control variable which is applied to a control loop that actuates a servo motor or other suitable rotary means to set the relative position of an air flow control flap within the induction tube. The control loop attempts to maintain the position of the air flow flap in continuous correspondence with the accelerator pedal position. The actuating current for the final control element is used as one input datum for a stored data field. Another input variable to the data field is the actual position of the air flow valve or flap. The data field contains empirically obtained data relating these two variables with the prevailing air flow rate and generates an output signal that is used as the air flow rate signal in a control pulse generator. The control pulse generator also receives other signals related, for example, to temperature, engine speed, etc. From this set of signals, the generator produces a fuel admission control signal, for example a fuel injection control pulse. The system includes special circuits for applying, for example, an engine idling correction signal to the control loop when the engine speed falls below a certain predetermined value.

6 Claims, 2 Drawing Figures

FUEL SUPPLY SYSTEM FOR INTERNAL COMBUSTION ENGINES

This is a continuation, of application Ser. No. 46,286, filed June 7, 1979 now abandoned.

FIELD OF THE INVENTION

The invention relates to fuel management in internal combustion engines. More particularly, the invention relates to a system for supplying fuel to an internal combustion engine on the basis of the control position of an air flow metering device in the induction tube and the use of characteristic engine data stored in a suitable memory.

BACKGROUND OF THE INVENTION

Known in the art are fuel supply systems in which the induction tube contains a standard air throttle and also an air flow metering flap or mechanism. The air flow meter is coupled to a suitable shaft encoder which generates a signal that is used in the subsequent preparation of a fuel injection control pulse. It is a distinct disadvantage of the known system that it requires two independent and separately movable control elements within the induction tube, i.e., the flap or valve and the metering flap of the air flow rate meter, thereby engendering substantial additional costs and complications.

OBJECT AND SUMMARY OF THE INVENTION

It is thus a principal object of the present invention to provide a fuel metering system in which the control of the air flow through the induction tube as well as the generation of an air flow rate signal are performed by a single movable element within the induction tube. This and other objects are attained, according to the invention, by providing a pressure-sensitive element within the induction tube whose relative position is controllable, and to associate this single movable element with an appropriate position transducer or shaft encoder for generating a position signal which is then applied to a fuel control pulse generator that governs the amount of fuel supplied to the engine.

It is a distinct advantage of the present invention that the mechanical complexity of the overall system is very low compared with that required in the aforementioned known apparatus. In spite of the mechanical simplicity, the system according to the invention is capable of fuel metering with a precision that insures fuel economy, exhaust gas purity and a generally superior driving feel.

It has been found especially advantageous if the single induction tube element is placed in its relative position by a controller acting on the basis of a gas pedal position signal. It has also been found advantageous to apply a separate idle control signal to the input of the air flap controller. The positioning of the induction tube element has advantageously been effected by means of rotary solenoids.

The invention will be better understood as well as further objects and advantages thereof become more apparent from the ensuing detailed description of two preferred exemplary embodiments taken in conjunction with the drawing.

DESCRIPTION OF THE PREFERRED EMBODIMENTS

Figure 1:
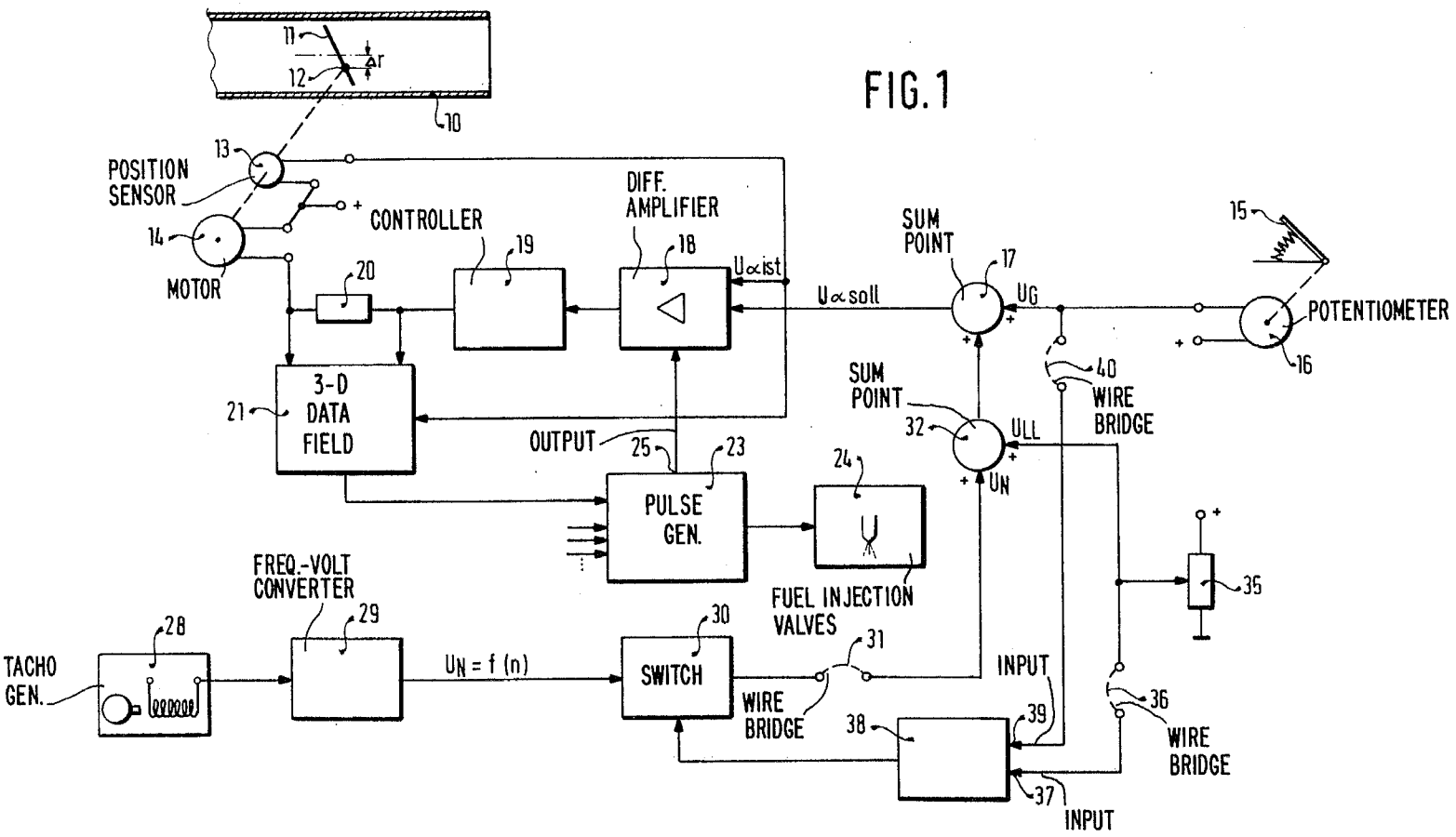
FIG. 1 is a schematic block diagram of an overall fuel management system including the improvements according to the invention.

Turning now to FIG. 1, there will be seen an overall block circuit diagram of the fuel management system of an internal combustion engine. Shown in FIG. 1 is a portion of an air induction tube 10 of an internal combustion engine of otherwise known construction whose details are omitted. Mounted pivotably within the induction tube 10 is a throttle butterfly valve 11 which is seen to be pivoted eccentrically with respect to the flap 11 within the induction tube 10, the distance between the center of the flap 11 and its eccentrically located pivotal point 12 being indicated by the symbol $\Delta r$. The rotary shaft of the throttle valve 11 engages a shaft encoder or position sensor 13 and continues to the drive shaft of an electric actuator 14. As shown in FIG. 1, $\Delta r$ does not indicate the rotary point of the baffle valve.

A gas pedal 15 cooperates with a position sensor, for example a potentiometer 16, to generate a signal related to the position of the gas pedal. This signal $U_g$ is applied to a summation point 17 whose output signal or a command position signal $U_{\alpha soll}$ is used as an input command variable for a differential amplifier 18. The output of the amplifier 18 engages a controller 19 that applies a control current to the final control element consisting of the motor 14 which rotates the throttle valve 11. The control current for the motor 14 passes through a measuring resistor 20 and the voltage across the resistor 20 is used as a first input signal for a three-dimensional data field 21. The second input variable for the data field 21 is the signal from the position encoder 13 which is also applied as the the actual throttle valve position signal or second input signal $U_{\alpha ist}$ to the differential amplifier 18. The data field 21 uses the two input signals to generate an output signal which is chosen experimentally to relate the values of the two input signal with an associated air flow rate through the induction tube. The air flow rate signal from the data field 21 is then applied as one of several input signals to a fuel control pulse generator 23 of known construction which uses the various input signals to generate therefrom an output control pulse that actuates one or several fuel injection valves 24. The various input signals to the control pulse generator 23 may be, for example, the air flow rate, the temperature, the engine speed, etc. The control pulse generator 23 provides a pulse and also provides a further pulse to be called a supplementary signal on an output 25; it is applied to a separate input of the differential amplifier 18 and provides an opportunity to adjust the output control signal from the amplifier 18.

The system according to the invention also includes a tacho-generator 28 which generates a signal related to the engine speed and applies it via a frequency-voltage converter or signal modulator 29 as an actuating signal to a switch 30 which controls the passage of an output signal from a comparator 38 to be described, via a circuit summation point 32, to the aforementioned circuit summation point 17.

The apparatus further includes a variable potentiometer 35 whose output voltage $U_{LL}$ may be applied to the circuit summation point 32 as well as via a wire bridge 36 as described below to one input of the comparator 38. The second input 39 of the comparator 38 is connected to the output of the gas pedal potentiometer 16 to receive the aforementioned gas pedal position signal $U_g$ via another wire bridge 40 as described below. The output signal from the comparator 38 goes to the switch 30 which controls its transmission in the manner described below.

The function and operation of the apparatus illustrated in FIG. 1 is as follows:

A spring or other elastic means, not shown, are provided to maintain the throttle valve 11 in its closed position when the engine is inoperative. Furthermore, any rotary torques applied by the motor 14 also act to keep the throttle valve 11 closed, i.e., they act in the same sense as the spring. The only forces which tend to open the throttle valve 11 are due to air flow pressure and herein generally referred to as the air flow through the induction tube which causes an opening torque due to the eccentric pivoting of the throttle valve 11.

The engine control derives from the position of the gas pedal 15 which is signaled by the potentiometer 16 as the nominal or command variable for the intended throttle valve position signal. The actual throttle valve position $U_{\alpha ist}$ is continuously transmitted to the control loop 18, 19 and causes the latter to apply a suitable control current to the motor 14 to maintain the actual throttle valve position signal $U_{\alpha ist}$ at or near the command position signal $U_{\alpha soll}$. The control current which the controller puts out through the resistor 20, and which is a measure of the power required to counteract the prevailing air flow through the induction tube, is applied as one input signal to the data field 21 while the second input signal is the actual throttle valve position. Empirical data derived from suitable tests on the particular engine which is being controlled are contained in the data field and correlate the input signals with an output signal that constitutes information related to the air flow rate through the induction tube. As already mentioned, this output signal is combined with other engine variables in the subsequent control pulse generator 23 for generating the final fuel injection control pulse.

In order to account for special conditions which obtain when the engine idles, the engine speed is sensed by the frequency-voltage converter or signal modulator 29 which causes the switch 30 to be closed when the engine speed falls below a predetermined value. In that case, the controller input signal $U_{\alpha soll}$ is automatically corrected to a value defined by the idling potentiometer 35. In order to permit an adjustment of the idling voltage $U_{LL}$ under operating conditions, the wire bridges 31, 36 and 40 are interrupted and the potentiometer 35 is suitably adjusted. In normal operation of this system, the wire bridges are closed.

For the purpose of establishing an idling rpm, a voltage corresponding to the pickup voltage at the potentiometer 35 is further added to the output voltage of the potentiometer 15, so that the result is a throttle valve position corresponding to the desired idling rpm. In doing so, the wire bridges 31, 36 and 40 are interrupted.

If these wire bridges are closed, then the result is a closed-loop idling rpm control, wherein on the basis of an rpm signal from the rpm transducer 28 influence is exerted on the voltage of the potentiometer 16. To this end, this potentiometer voltage is compared with the voltage of the idling potentiometer 35 in the comparator 38 and in the case of idling the switch 30 is closed, as a result of which a corresponding voltage is established at the set-point input of the differential amplifier 18.

Figure 2:
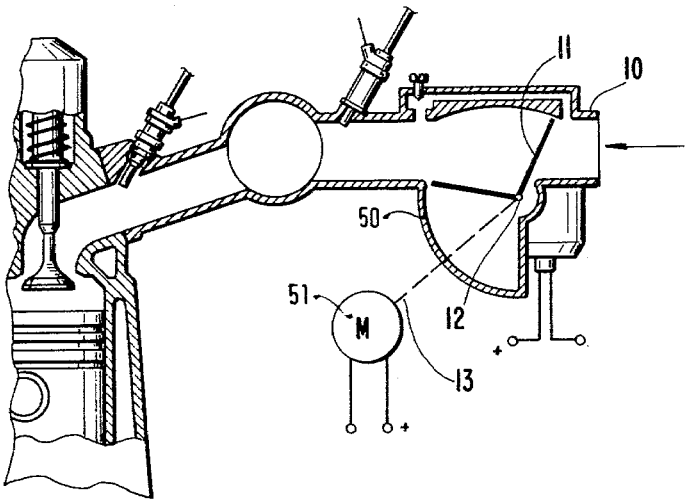
FIG. 2 is a sectional diagram of portions of a fuel supply system according to a variant of the present invention.

The system according to the invention may be used with a known air flow rate meter 50 shown in partial section in FIG. 2. The flow rate meter 50 is coupled to a servo motor 51 that provides a motor torque thereto by shaft encoder or position sensor 13. In order to complete this embodiment, a suitable spring or other elastic means are provided to cause a closing torque to be applied to the metering flap 11. The motor torque must also be such as to tend to close the air metering flap.

It will be appreciated that the unidirectional torque applied by the final control elements 14 or 51 may be provided by electric motors, servo motors or positioning solenoids, provided only that the actuating signal for these elements is used to determine empirically an air flow rate that is related to the magnitude of the actuating signal.

This relation is different for each type of air flow valve and depends also on the degree of eccentricity, i.e., the magnitude of the quantity $\Delta r$. The larger the quantity $\Delta r$, the greater the sensitivity of the system, due to the increase of torque.

The data field 21 may suitably be a digital matrix or some other suitable data storage device in which output values are previously associated with corresponding input values according to the type of engine and the type of air flow meter which is being used.

The foregoing relates to merely preferred exemplary embodiments of the invention, it being understood that other embodiments and variants thereof are possible without departing from the spirit and scope of the invention.

What is claimed and desired to be secured by Letters Patent of the United States is:

1. A fuel control system for an internal combustion engine, said control system including an air induction tube having a linear axis and an accelerator pedal, said control system comprising:

an air flow pressure-responsive element comprising an eccentrically pivotally disposed valve member in said induction tube;

positioning means coupled to said valve member for angularly setting the position of said valve member with respect to the axis of said induction tube;

a control loop for generating a position control signal for said positioning means whereby the position of said valve member with respect to said axis of the air induction tube is adjusted by said control loop on the basis of a signal generated by a position sensor controlled by the position of the accelerator pedal;

processor means for processing said position control signal generated by said control loop and for generating an air flow rate signal;

a fuel control signal generator for receiving signals from said processor means and for generating fuel control signals on the basis of engine condition signals; and fuel admission means responsive to signals from said fuel control signal generator for admitting fuel to said engine on the basis of fuel control signals directed to said fuel control signal generator.

2. A system according to claim 1, wherein said processor means is a multivariate data field and wherein said system further includes a position control encoder for generating a position signal related to the actual position of said valve member, said position control signal also being applied to said multivariate data field.

3. A system according to claim 1, wherein said valve member is a butterfly valve which is pivoted eccentrically and whose relative position with respect to the induction tube is adjusted by said control loop on the basis of the position of the accelerator pedal of the engine.

4. A system according to claim 1, comprising a secondary signal generator for generating a secondary signal related to the condition of engine idling, and wherein said accelerator pedal is associated with an accelerator pedal position transducer which provides a primary control signal for said control loop, and means for combining said primary and secondary signals.

5. A system according to claim 1, wherein said positioning means is an electric motor.

6. A system according to claim 1, wherein said positioning means is a rotary solenoid.

* * * * *